US007284606B2

(12) United States Patent
Coronado

(10) Patent No.: US 7,284,606 B2
(45) Date of Patent: Oct. 23, 2007

(54) DOWNHOLE POSITION LOCATING DEVICE WITH FLUID METERING FEATURE

(75) Inventor: Martin P. Coronado, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 273 days.

(21) Appl. No.: 11/104,067

(22) Filed: Apr. 12, 2005

(65) Prior Publication Data

US 2006/0225878 A1 Oct. 12, 2006

(51) Int. Cl.
*E21B 47/09* (2006.01)

(52) U.S. Cl. ..... 166/255.1; 166/242.7; 166/238; 166/381

(58) Field of Classification Search ..... 166/255.1, 166/242.7, 238, 381
See application file for complete search history.

(56) References Cited

U.S. PATENT DOCUMENTS 2,999,542 A 9/1961 Myers
3,061,010 A 10/1962 Martin et al.
3,112,794 A 12/1963 Chenoweth
3,638,723 A 2/1972 Carroll
3,696,865 A * 10/1972 Chapman ..... 166/64
3,902,361 A 9/1975 Watson
4,067,386 A * 1/1978 Weise ..... 166/64
4,614,233 A * 9/1986 Menard ..... 166/206
5,092,402 A * 3/1992 Perricone et al. ..... 166/113
5,269,374 A * 12/1993 Taylor ..... 166/255.2

* cited by examiner

*Primary Examiner*—William Neuder
*Assistant Examiner*—Nicole Coy
(74) *Attorney, Agent, or Firm*—Steve Rosenblatt

(57) ABSTRACT

A tool for multiple purposes features one ore more dogs that can engage a collar groove or restriction sub in the wellbore. The dogs are extendable through a sleeve biased in opposed directions and are supported from a mandrel. The dogs can retract into mandrel grooves to clear restrictions on the trip into the well. On the way up to a collar that has just been passed, the dogs engage and an upward pull on the mandrel displaces fluid through a restriction to allow enough time to get a meaningful surface signal of the overpull force. Thereafter, the applied force can be reduced as the dogs release at a lower applied force to reduce the slingshot effect. The tool can be inverted and used to keep a constant force on a bottom hole assembly during offshore drilling where a heave compensator is employed.

26 Claims, 2 Drawing Sheets

DOWNHOLE POSITION LOCATING DEVICE WITH FLUID METERING FEATURE

FIELD OF THE INVENTION

The field of this invention is devices that can be used downhole to locate collars and/or other features in the wellbore and give a surface signal of such location or in a reverse orientation can be used to apply a predetermined load on a bottom hole assembly (BHA).

BACKGROUND OF THE INVENTION

Frequently the specific depth of collars and/or other features in the wellbore in a casing string needs to be located with an indication at the surface that the collar has been properly located. In the past this function has been approached with a tool delivered on a string that has one or more collets. The collets and the mandrel that backs them up are configured to allow the collets to remain in an unsupported position for downhole tripping. After the desired collar is reached the tool with the collets is further advanced downhole beyond a locating groove in the collar that is of interest. The tool is then picked back up to engage the collar. Doing this traps the collet in the groove and an overpull is applied. The resistance to the overpull is sensed at the surface. The collet is designed to release after a predetermined level of pulling force is reached.

There are several issues with this design. In deep wells with a significant amount of deviation there is a substantial risk of drag of the work string in the surrounding tubular so that the overpull applied could be the force required to dislodge the work string as opposed to a pull on the collets that may not even have landed in the locator groove of the collar in question. This drag effect induced by depth and well deviation is commonly referred to as a "slip/stick effect". There may be no ascertainable signal at the surface if the slip/stick effect is present. Another problem is the limit of stress that can be applied to the collet heads that are in the locating groove. While the collet structure can be made thicker the problem there is that the material may be limited in the level of stress that can be endured on the trapped collet heads. Another issue is limited space and tool diameter restriction required to actually deliver the tool to the collar in interest. Thus making the parts thicker may not be sufficiently helpful to increase the overall rating toward the desired pulling force required or there may not be the room required to go this route. Another issue with the collet based systems is that upon release there is a slingshot effect as the stored potential energy in the applied pulling force on the work string is suddenly released as the collets become unsupported when a predetermined pulling force is reached.

Accordingly what is needed and is addressed by the present invention is a tool that can handle greater applied forces than the collet based designs and on that can eliminate the slingshot effect. Other desirable features can be a built in delay that allows higher loads to be applied for a defined time period to be sure that the collar is properly located and that the slip/stick forces have been overcome. A rapid re-cocking of the tool after a release for repeated testing is also a feature. The tool can be inverted and properly regulated so as to apply a predetermined downward force on a bottom hole assembly working in conjunction with a heave compensator for offshore drilling applications. These and other features of the present invention will become more apparent to those skilled in the art from a review of the description of the preferred embodiment, the drawings and the claims that determine the scope of the invention, all of which appear below.

SUMMARY OF THE INVENTION

A tool for multiple purposes features one ore more dogs that can engage a collar groove or restriction sub in the wellbore. The dogs are extendable through a sleeve biased in opposed directions and are supported from a mandrel. The dogs can retract into mandrel grooves to clear restrictions on the trip into the well. On the way up to a collar that has just been passed, the dogs engage and an upward pull on the mandrel displaces fluid through a restriction to allow enough time to get a meaningful surface signal of the overpull force. Thereafter, the applied force can be reduced as the dogs release at a lower applied force to reduce the slingshot effect. The tool can be inverted and used to keep a constant force on a bottom hole assembly during offshore drilling where a heave compensator is employed.

BRIEF DESCRIPTION OF THE DRAWINGS

FIGS. 2*a*-2*b* show the tool in section in the position for clearing an obstacle on run in;

DETAILED DESCRIPTION OF THE PREFERRED EMBODIMENT

Figure 1A:
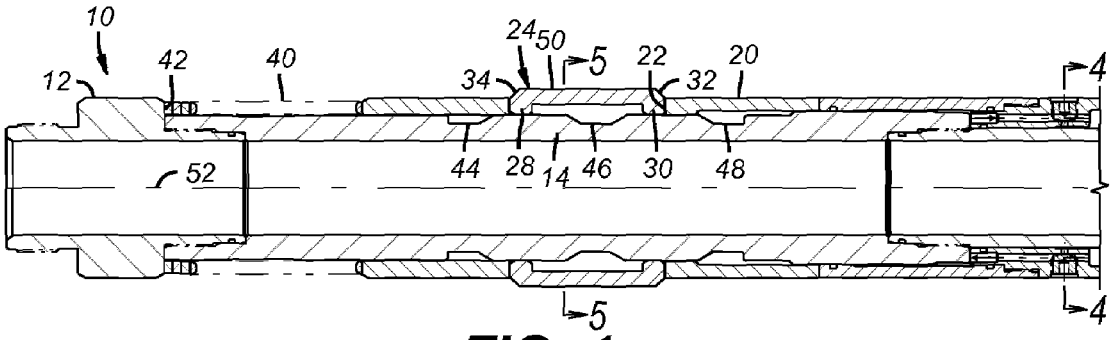
FIGS. 1*a*-1*b* show the tool in section in the neutral run in position.
Figure 5:
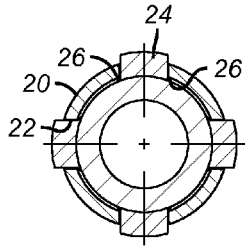
FIG. 5 is a section view along lines 5-5 of FIG. 1*a*.

The mandrel 10 is made up of top sub 12, upper body 14, lower body 16 and bottom sub 18. These pieces are preferably threaded together but may be attached in other ways. More or fewer pieces can be used to define the mandrel 10. An outer sleeve 20 has a window 22 for each dog 24 that is used. One or more dogs 24 can be used. Dogs 24 have tabs 26 at opposed ends, as best seen in FIG. 5 to limit the outward travel of the dogs 24 with respect to window 22. FIG. 1*a* shows the dog 24 in section. In the preferred form of dog 24, it is generally U-shaped having a pair of inwardly oriented legs 28 and 30. On the trip into the well surface 32 on dog 24 will encounter an obstacle. On the trip out of the well, surface 34 on dog 24 will encounter an obstacle.

Sleeve 20 is mounted to slide over mandrel 10. It is biased uphole by spring 36 that bears on surface 38 of bottom sub 18. Spring 40 bears on surface 42 of top sub 12 and applies an opposing force to sleeve 20 than spring 36. Preferably spring 40 is weaker than spring 36 for reasons that will be explained below.

Figure 2A:
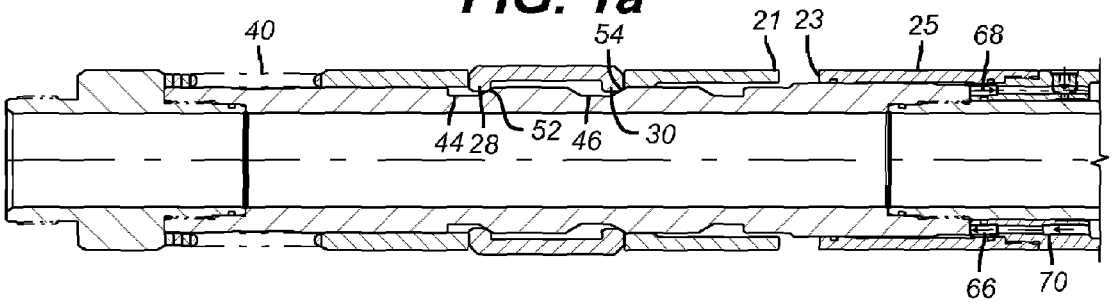

Upper body 14 has three grooves 44, 46, and 48. These grooves are deep enough so that when legs 28 and 30 are in them, outer surface 50 of dogs 24 recedes inside of window 22. In this manner the tool can pass an obstruction going downhole and can be removed after release going uphole. If an obstruction is encountered by surface 32 going in the hole, the spring 40 is compressed as the sleeve 20 and dogs 24 stop downhole motion. Continued downhole movement of mandrel 10 not only compresses spring 40 but also positions grooves 44 and 46 in alignment with legs 28 and 30 of dogs 24 to allow them to retract to a position closer to the central axis 52 and preferably within sleeve 20. At that point the obstruction can be passed and spring 40 can bias the sleeve 20 back into the neutral position shown in FIG. 1. FIG. 2 shows the legs 28 and 30 getting cammed out of grooves 44 and 46 by the action of spring 40 after the obstruction going downhole is cleared. Note that sloping surfaces 52 and 54 facilitate the exit of legs 28 and 30 from grooves 44 and 46 under the return force of the formerly compressed spring 40. With the obstacle cleared going downhole, the dogs 24 resume the neutral run in position shown in FIG. 1.

Figure 3A:
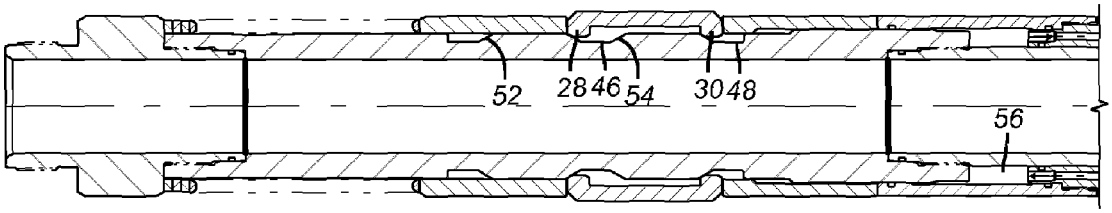
FIGS. 3*a*-3*b* show the tool is section in the load applied position just prior to release.
Figure 2B:
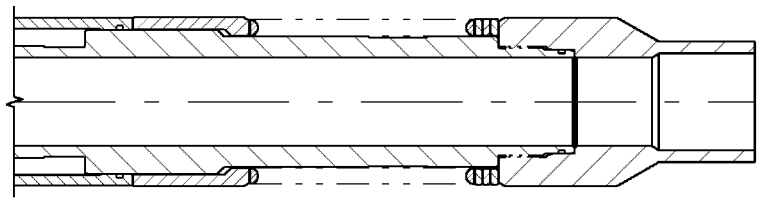
Figure 3B:
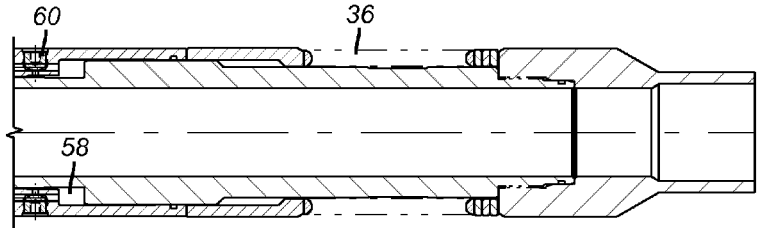
Figure 4:
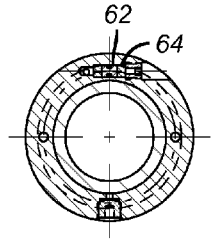
FIG. 4 is a section along lines 4-4 of FIG. 1*b*.

Defined between the sleeve 20 and the mandrel 10 and best seen in FIG. 3 are an upper fluid reservoir 56 and a lower fluid reservoir 58. A fill port 60 allows charging the fluid at the surface. Thermal and hydrostatic effects in this closed system of interconnected reservoirs are fully compensated by a piston 62 that can be biased by Belleville washers 64, for example, or any other device that is comparable. Those skilled in the art will appreciate the benefit of such compensation on the structure of the device especially when it is deployed at great depths and/or high temperature applications. FIG. 4 illustrates this execution of a compensation feature. FIG. 2*b* best illustrates other features of this reservoir system. There is a flow restrictor 66 that regulates the flow rate from reservoir 58 into reservoir 56. There is a check valve 68 that permits a bypass of restrictor 66 when the fluid is flowing in the opposite direction from reservoir 56 to reservoir 58. A pressure relief device 70 is in line with the restrictor 66 so that when fluid is urged in a direction from reservoir 58 to reservoir 56 there will have to be a rise in the driving pressure to cause such flow to a predetermined level before any flow begins.

Broadly stated, the fluid system is operative to create a delay as the dogs 24 are in the desired location and a force is applied to the mandrel 10 to create a surface signal for such engagement prior to the release of the dogs 24 from the locating groove (not shown). The system serves to allow a reduction of the applied pulling force before release to reduce the slingshot effect from release. When used with the optional pressure relief device 70 the tool can be inverted and can be used to apply a load in a predetermined range on a BHA without concern for premature release, such as an offshore drilling application where a heave compensator system is employed.

Figure 1B:
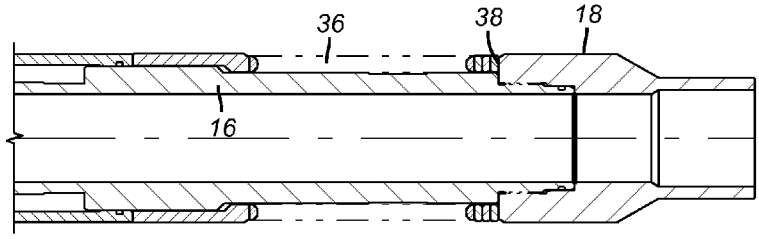

Now that the main components have been described, the operation of the tool in various applications will be discussed in more detail. FIG. 1 shows the run in position with the dogs 24 having legs 28 and 30 out of any of the grooves 44, 46 and 48. Preferably, the dogs 24 are biased into the FIG. 1 position where legs 28 and 30 straddle groove 46 by virtue of spring 36 overpowering spring 40 to move sleeve 20 to the FIG. 1 position. As the tool is brought downhole, an obstacle will first hit surface 32 on dogs 24. The mandrel 10 will continue downhole as the dogs 24 stop the descent of the sleeve 20. As grooves 44 and 46 come into alignment with legs 28 and 30, the dogs 24 will be able to retract sufficiently to allow the tool to continue past the obstacle. The dogs 24 can retract within sleeve 20 as much as necessary to allow the obstacle to be cleared. The advancing of the mandrel 10 with the dogs 24 temporarily stuck on an obstacle, compresses spring 40. After the obstacle is cleared, spring 40 relaxes to return the tool to the FIG. 1 position from the FIG. 2 position. It should be noted that advancing the mandrel downhole with the dogs 24 stopped by an obstacle will result in sleeve 20 taking dogs 24 against the bias of spring 40 taking the lower end 21 of sleeve 20 away from upper end 23 of sleeve 25, whose relative movement with respect to the mandrel 10, at other times, creates movement of fluid between reservoirs 56 and 58. The amount of this movement to reset the dogs 24 to the FIG. 1 position after clearing the obstacle is also quite short.

When the desired depth is reached, the tool is pulled up until the surface 34 engages a desired locating groove downhole. At that point, further upward pulling on the mandrel 10 from the work string (not shown) will force fluid from reservoir 58 to reservoir 56 through restrictor 66. This regulates the rate of movement of mandrel 10 as the force is being applied to give surface personnel the time to notice a signal that the desired groove has been engaged and a force that well exceeds the potential drag force from friction of slip/stick effects on the work string in a deviated wellbore are applied. The rig crew can then actually lower the applied pulling force before the actual release happens to reduce the slingshot effect from the release. Release occurs after the mandrel 10 moves a sufficient distance to place grooves 46 and 48 in alignment with legs 28 and 30 to allow the dogs 24 to retract and the tool to be returned to the FIG. 1 position. This occurs because the pulling uphole with the dogs 24 in the locating groove compresses spring 36 as seen in FIG. 3. Retraction of the dogs 24 allows spring 36 to overcome spring 40 and the tool returns to the FIG. 1 position, ready for another cycle. With the use of the optional relief device 70 the surface personnel are assured that a pulling force up to a predetermined level will not initiate the release sequence. Hence force can be applied and removed any number of times before there is a release. Those skilled in the art will appreciate that the tool can be used in an inverted orientation and function similarly in one application, for example where a range of weight on a BHA is desired in a given range without fear of initiating a release sequence. In such an application, rather than a pulling force uphole, a pushing force downhole is applied with the dogs 24 engaged in a receptacle. Combining with the use of the optional relief device 70 no fluid flow between reservoirs 56 and 58 can happen until a predetermined force is exceeded. This configuration can be used in offshore drilling in conjunction with heave compensators.

Those skilled in the art will now appreciate that the described tool can allow applied forces in the order of 100,000 or more where the collet designs were more limited to lower applied forces in the order of 40,000 pounds or less. These lower limits on the collet designs were sometimes not sufficient to exceed friction and slip/stick effects on the work string in highly deviated holes. The use of a dog structure extending through a window and more specifically a dog design having thick upper and lower ends using legs 28 and 30 accounts at least in part for the ability to apply higher forces to clear obstacles and to test the location of the tool in a desired groove in a specific collar, for example. The use of the check valve 68 allows the tool to quickly find its neutral position after a release so that the test can be quickly repeated, if desired. The use of the restrictor 66 allows more time at the surface to hold a force before release and further allows lowering the applied force after the passage of time but before release to reduce the slingshot effect from release. The pressure relief device 70 allows application of force for any desired time without fear of release if the force is kept at a level where the relief device remains closed. The fluid used on the reservoirs can be a liquid or gas. The compensator 62 is an optional feature. The tool is serviceable in the well in opposed orientations depending on the intended service. Although 4 dogs 24 are illustrated one or more such dogs can be used. Biasing of springs 36 and 40 can be accomplished by equivalent devices.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claims, including the full range of equivalency to which each element thereof is entitled.

I claim:

1. A tool to selectively engage downhole and to withstand a predetermined applied force while so selectively engaged, comprising:

a mandrel having a longitudinal axis;

a sleeve mounted to said mandrel and further comprising at least one window through which a dog is mounted for radial extension to engage downhole and retraction to release downhole; and a time delay feature during which a sufficiently large force that serves as a signal confirming engagement can be applied to said engaged dog without a release of engagement of said dog downhole thereby allowing time for a subsequent reduction of applied force to said dog before it releases downhole.

2. The tool of claim 1, wherein:

said sleeve is relatively movable with respect to said mandrel.

3. The tool of claim 2, wherein:

the rate of said relative movement is regulated.

4. The tool of claim 3, wherein:

said relative movement is less regulated in one direction than the opposite direction.

5. The tool of claim 1, wherein:

said mandrel comprises a plurality of recesses to allow said dog to retract when a force is applied to said mandrel in opposed directions with said dog engaged while radially extended downhole.

6. The tool of claim 5, wherein:

said dog comprises and uphole and downhole end and legs adjacent said ends that selectively straddle or enter said recesses.

7. The tool of claim 6, wherein:

said legs give said dog a substantially U-shape.

8. The tool of claim 1, wherein:

said dog can withstand a pulling force on said mandrel of at least about 100,000 pounds when said dog is radially extended and engaged downhole.

9. The tool of claim 1, wherein:

said sleeve is biased in opposed directions.

10. The tool of claim 9, wherein:

said bias in one direction exceeds said bias in the opposed direction.

11. The tool of claim 1, wherein:

said tool is functional regardless of which end of it is oriented downhole.

12. A tool to selectively engage downhole and to withstand a predetermined applied force while so selectively engaged, comprising:

a mandrel having a longitudinal axis;

a sleeve mounted to said mandrel and further comprising at least one window through which a dog is mounted for radial extension to engage downhole and retraction to release downhole;

said sleeve is relatively movable with respect to said mandrel;

the rate of said relative movement is regulated;

said regulation comprises driving a fluid through a restriction.

13. The tool of claim 12, wherein:

said restriction regulates flow between reservoirs in one direction and flow between said reservoirs in an opposed direction bypasses said restriction.

14. The tool of claim 13, wherein:

said bypassing occurs through a check valve mounted in a discrete passage between said reservoirs from a second passage where said restriction is located.

15. The tool of claim 14, wherein:

said second passage further comprises a relief device that prevents flow between reservoirs until a predetermined pressure is reached in one of said reservoirs.

16. A tool to selectively engage downhole and to withstand a predetermined applied force while so selectively engaged, comprising:

a mandrel having a longitudinal axis;

a sleeve mounted to said mandrel and further comprising at least one window through which a dog is mounted for radial extension to engage downhole and retraction to release downhole;

said sleeve is relatively movable with respect to said mandrel;

the rate of said relative movement is regulated;

said relative movement between said mandrel and said sleeve creates a pressure driving fluid from a first to a second reservoir therebetween and said regulation occurs from a flow restrictor between said reservoirs.

17. The tool of claim 16, wherein:

a predetermined relative movement, responsive to a force applied to said mandrel with said dog radially extended and engaged downhole, allows said dog to retract;

said restrictor controlling the time for such relative movement, that allows said dog to retract to occur, sufficiently to allow reduction in the applied force prior to said dog retraction.

18. The tool of claim 16, wherein:

said pressure that drives fluid is not created when said relative movement occurs as said sleeve is clearing an obstruction in the wellbore when the tool is being lowered therein.

19. A tool to selectively engage downhole and to withstand a predetermined applied force while so selectively engaged, comprising:

a mandrel having a longitudinal axis;

at least one dog mounted to said mandrel to move selectively and radially with respect to said axis for engagement and release downhole;

a regulation device to control the rate of relative movement between said mandrel and said dog when said dog is engaged and a force is applied to said mandrel, said regulation device providing a time delay during which a sufficiently large force that serves as a signal confirming engagement can be applied to said engaged dog without a release of engagement of said dog downhole thereby allowing time for a subsequent reduction of applied force to said dog before it releases downhole.

20. A tool to selectively engage downhole and to withstand a predetermined applied force while so selectively engaged, comprising:

a mandrel having a longitudinal axis;

at least one dog mounted to said mandrel to move selectively and radially with respect to said axis for engagement and release downhole;

a regulation device to control the rate of relative movement between said mandrel and said dog when said dog is engaged and a force is applied to said mandrel;

said regulation device comprises interconnected reservoirs separated by a fluid flow restrictor between them;

whereupon application of force to said mandrel with said dog engaged downhole causes flow between said reservoirs.

21. The tool of claim 20, wherein:

said flow restrictor is mounted in a first passage and a bypass passage with a one way valve is mounted in a second passage.

22. The tool of claim 21, wherein:

said dog is mounted through a window in a sleeve and said sleeve is slidably mounted to said mandrel, whereupon restriction of the rate of relative movement between said mandrel and said sleeve occurs in one direction where fluid is forced through said restrictor and does not occur in an opposite direction where fluid bypasses said restrictor and flows through said one way valve.

23. The tool of claim 22, wherein:

a pressure relief device mounted in line with said restrictor to prevent flow therethrough until a predetermined force is applied to said mandrel with said dog engaged downhole.

24. The tool of claim 22, wherein:

said sleeve is biased in opposed directions with the bias in one direction exceeding the bias in the opposite direction.

25. The tool of claim 22, wherein:

said dog comprises at least one leg extending toward said mandrel, said mandrel comprising at least one recess to allow said dog to retract toward said sleeve upon sufficient relative movement between said mandrel and said sleeve puts said leg into alignment with said recess.

26. The tool of claim 20, wherein:

said reservoirs are compensated for thermal effects on the fluid in said reservoirs and hydrostatic pressure in the wellbore.

* * * * *